US009451805B2

(12) United States Patent
Barnes et al.

(10) Patent No.: US 9,451,805 B2
(45) Date of Patent: Sep. 27, 2016

(54) ARTICLE OF FOOTWEAR WITH SUPPORT ASSEMBLY HAVING PRIMARY AND SECONDARY MEMBERS

(71) Applicant: NIKE, Inc., Beaverton, OR (US)

(72) Inventors: Elizabeth Barnes, Portland, OR (US); Margarita Cortez, Beaverton, OR (US); Zachary Elder, Portland, OR (US); Fred Fagergren, Hillsboro, OR (US); Lee Peyton, Tigard, OR (US)

(73) Assignee: NIKE, Inc., Beaverton, OR (US)

( * ) Notice: Subject to any disclaimer, the term of this patent is extended or adjusted under 35 U.S.C. 154(b) by 243 days.

(21) Appl. No.: 13/951,904

(22) Filed: Jul. 26, 2013

(65) Prior Publication Data

US 2015/0027000 A1 Jan. 29, 2015

(51) Int. Cl.
*A43B 13/18* (2006.01)

(52) U.S. Cl.
CPC ..... *A43B 13/183* (2013.01)

(58) Field of Classification Search
CPC ..... A43B 13/183; A43B 13/185
USPC ..... 36/25 R, 28, 34 R, 87
See application file for complete search history.

(56) References Cited

U.S. PATENT DOCUMENTS

| | | | | |
|---|---|---|---|---|
| 337,146 | A * | 3/1886 | Glueoksmann | 36/7.8 |
| D122,166 | S | 8/1940 | Korda | |
| 2,334,719 | A * | 11/1943 | Margolin | 36/3 B |
| 2,364,134 | A * | 12/1944 | Dow et al. | 428/94 |
| 3,214,849 | A | 11/1965 | Nadaud | |
| 4,414,760 | A * | 11/1983 | Faiella | 36/29 |
| 4,815,221 | A * | 3/1989 | Diaz | 36/27 |
| 4,901,987 | A * | 2/1990 | Greenhill et al. | 267/166 |
| 5,517,769 | A | 5/1996 | Zhao | |
| 5,528,842 | A | 6/1996 | Ricci et al. | |
| 5,639,074 | A * | 6/1997 | Greenhill et al. | 267/162 |
| 6,205,681 | B1 * | 3/2001 | Kita | 36/28 |
| 6,282,814 | B1 * | 9/2001 | Krafsur et al. | 36/27 |
| 6,311,414 | B1 * | 11/2001 | Kita | 36/28 |
| 6,374,515 | B1 * | 4/2002 | Davis | 36/97 |
| 6,393,732 | B1 * | 5/2002 | Kita | 36/30 R |
| 6,502,330 | B1 * | 1/2003 | David et al. | 36/88 |
| 6,665,957 | B2 * | 12/2003 | Levert et al. | 36/27 |
| 6,669,184 | B2 * | 12/2003 | Leevy et al. | 267/162 |
| 6,775,930 | B2 * | 8/2004 | Fuerst | 36/103 |
| 6,807,752 | B2 * | 10/2004 | Nakano et al. | 36/25 R |
| D530,065 | S * | 10/2006 | Edwards | D2/953 |
| 7,162,815 | B2 * | 1/2007 | Miyauchi et al. | 36/103 |
| 7,216,443 | B2 * | 5/2007 | Baden et al. | 36/34 R |
| 7,314,125 | B2 * | 1/2008 | Smaldone et al. | 188/372 |
| 7,555,847 | B2 | 7/2009 | Kendall | |
| 7,627,961 | B2 * | 12/2009 | Brewer et al. | 36/3 B |
| 7,730,635 | B2 * | 6/2010 | Aveni et al. | 36/27 |
| 7,788,824 | B2 | 9/2010 | Hann | |
| D636,570 | S * | 4/2011 | Merritt et al. | D2/951 |
| D641,545 | S * | 7/2011 | Niedner | D2/946 |
| D659,963 | S * | 5/2012 | Merritt et al. | D2/951 |
| 8,464,439 | B2 * | 6/2013 | Monfils et al. | 36/28 |

(Continued)

*Primary Examiner* — Richale Quinn
*Assistant Examiner* — Anne Kozak
(74) *Attorney, Agent, or Firm* — Banner & Witcoff, Ltd.

(57) ABSTRACT

An article of footwear includes an upper, a midsole, a support assembly beneath the midsole, and an outsole. The support assembly includes a primary member and a secondary member engaged with the primary member. A portion of the secondary member extends through an aperture in the primary member. An opening in the primary member exposes the aperture to an exterior of the primary member.

34 Claims, 7 Drawing Sheets

(56) References Cited

U.S. PATENT DOCUMENTS

| | | | | |
|---|---|---|---|---|
| 8,707,587 | B2 * | 4/2014 | Christensen et al. | 36/102 |
| 8,752,306 | B2 * | 6/2014 | Goldston et al. | 36/27 |
| 2003/0000108 | A1 * | 1/2003 | Kita | 36/28 |
| 2003/0000109 | A1 * | 1/2003 | Kita | 36/30 R |
| 2003/0163933 | A1 * | 9/2003 | Krafsur et al. | 36/27 |
| 2005/0102857 | A1 * | 5/2005 | Yen | 36/28 |
| 2005/0102858 | A1 * | 5/2005 | Yen | 36/28 |
| 2005/0102859 | A1 * | 5/2005 | Yen | 36/28 |
| 2005/0108897 | A1 * | 5/2005 | Aveni | 36/27 |
| 2005/0126039 | A1 * | 6/2005 | LeVert et al. | 36/27 |
| 2005/0126040 | A1 | 6/2005 | LeVert et al. | |
| 2006/0130362 | A1 * | 6/2006 | Juan | 36/27 |
| 2006/0254087 | A1 * | 11/2006 | Fechter | 36/27 |
| 2006/0265902 | A1 * | 11/2006 | Kita et al. | 36/12 |
| 2007/0043630 | A1 * | 2/2007 | Lyden | 705/26 |
| 2007/0101617 | A1 * | 5/2007 | Brewer et al. | 36/103 |
| 2007/0266593 | A1 * | 11/2007 | Schindler et al. | 36/28 |
| 2008/0052965 | A1 * | 3/2008 | Sato | 36/103 |
| 2008/0209762 | A1 * | 9/2008 | Krafsur | 36/27 |
| 2008/0282579 | A1 * | 11/2008 | Bobbett et al. | 36/127 |
| 2009/0145004 | A1 * | 6/2009 | Jones | 36/88 |
| 2009/0241370 | A1 * | 10/2009 | Kimura | 36/28 |
| 2009/0241371 | A1 * | 10/2009 | Kimura et al. | 36/28 |
| 2009/0241373 | A1 * | 10/2009 | Kita et al. | 36/44 |
| 2009/0241377 | A1 * | 10/2009 | Kita et al. | 36/107 |
| 2010/0058617 | A1 * | 3/2010 | Hwang | 36/102 |
| 2011/0138652 | A1 * | 6/2011 | Lucas et al. | 36/28 |
| 2012/0324760 | A1 * | 12/2012 | Ochoa | 36/102 |
| 2013/0031804 | A1 * | 2/2013 | Abshire | 36/103 |
| 2013/0118028 | A1 * | 5/2013 | Yoon | 36/27 |
| 2013/0192090 | A1 * | 8/2013 | Smith, IV | 36/103 |
| 2014/0059888 | A1 * | 3/2014 | Blevens et al. | 36/92 |
| 2014/0068966 | A1 * | 3/2014 | Chaffin | 36/28 |
| 2014/0115925 | A1 * | 5/2014 | Hurd et al. | 36/103 |
| 2014/0259747 | A1 * | 9/2014 | Baudouin et al. | 36/29 |
| 2014/0259785 | A1 * | 9/2014 | Lester et al. | 36/102 |
| 2014/0310982 | A1 * | 10/2014 | Delattre et al. | 36/28 |
| 2014/0331518 | A1 * | 11/2014 | Mayer | 36/28 |
| 2015/0047229 | A1 * | 2/2015 | Elliott et al. | 36/102 |
| 2015/0089834 | A1 * | 4/2015 | Baum et al. | 36/27 |

* cited by examiner

ARTICLE OF FOOTWEAR WITH SUPPORT ASSEMBLY HAVING PRIMARY AND SECONDARY MEMBERS

FIELD

Aspects of this invention relate generally to an article of footwear with an improved sole assembly and, in particular, to an article of footwear with a sole assembly having a support assembly with at least one primary member and at least one secondary member engaged with the primary member.

BACKGROUND

Conventional articles of athletic footwear generally include two primary elements, an upper and a sole assembly or sole structure. The upper is secured to the sole structure and forms a void on the interior of the footwear for comfortably and securely receiving a foot. The sole structure is secured to a lower portion of the upper and is positioned between the foot and the ground. The sole structure generally incorporates multiple layers that are conventionally referred to as an insole, a midsole, and an outsole. The insole, or sockliner, is a thin, compressible member located within the void and proximate a lower surface of the foot to enhance footwear comfort.

The outsole forms a ground-engaging portion (or other contact surface-engaging portion) of the sole structure, and is formed from a durable and wear-resistant material that includes texturing to improve traction.

To keep a wearer safe and comfortable, footwear is called upon to perform a variety of functions. For example, the sole structure of footwear should provide adequate support and impact force attenuation properties to prevent injury and reduce fatigue, while at the same time provide adequate flexibility so that the sole structure articulates, flexes, stretches, or otherwise moves to allow an individual to fully utilize the natural motion of the foot.

The midsole, which is conventionally secured to the upper along the length of the upper, forms a middle layer of the sole structure and is primarily responsible for attenuating ground (or other contact surface) reaction forces to lessen stresses upon the foot and leg, may also beneficially utilizing such ground reaction forces for more efficient toe-off, and control potentially harmful foot motions, such as over pronation. Conventional midsoles may include a foam material to attenuate impact forces and absorb energy when the footwear contacts the ground during athletic activities. Other midsoles may utilize fluid-filled bladders (e.g., filled with air or other gasses) to attenuate impact forces and absorb energy.

Although foam materials in the midsole succeed in attenuating impact forces for the foot, foam materials that are relatively soft may also impart instability that increases in proportion to midsole thickness. For example, the use of very soft materials in the midsole of running shoes, while providing protection against vertical impact forces, can encourage instability of the ankle, thereby contributing to the tendency for over-pronation. This instability has been cited as a contributor to "runner's knee" and other athletic injuries. For this reason, footwear design often involves a balance or tradeoff between impact force attenuation and stability.

Stabilization is also a factor in sports like basketball, volleyball, football, and soccer. In addition to running, an athlete may be required to perform a variety of motions including transverse movement; quickly executed direction changes, stops, and starts; movement in a backward direction; and jumping. While making such movements, footwear instability may lead to excessive inversion or eversion of the ankle joint, potentially causing an ankle sprain.

High-action sports, such as soccer, basketball, football, rugby, ultimate, etc., impose special demands upon players and their footwear. Accordingly, it would be desirable to provide footwear that achieves better dynamic control of the wearer's movements, while at the same time providing impact-attenuating features that protect the wearer from excessive impact loads.

It would be desirable to provide an article of footwear with a sole assembly that reduces or overcomes some or all of the difficulties inherent in prior known devices. Particular advantages will be apparent to those skilled in the art, that is, those who are knowledgeable or experienced in this field of technology, in view of the following disclosure of the invention and detailed description of certain embodiments.

SUMMARY

The principles of the invention may be used to provide an article of footwear with an improved support assembly. In accordance with a first aspect, an article of footwear includes an upper, a midsole, a support assembly beneath the midsole, and an outsole. The support assembly includes a primary member including a front portion, a central portion, a rear portion, a first aperture, and a second aperture. A secondary member includes a front portion, a central portion, and a rear portion, and extends through the first aperture and the second aperture such that the front portion of the secondary member is positioned above the front portion of the primary member, the central portion of the primary member is positioned above the central portion of the secondary member, and the rear portion of the primary member is positioned above the rear portion of the secondary member.

In accordance with another aspect, an article of footwear includes an upper, a midsole positioned beneath the upper, and a support assembly positioned beneath the midsole. The support assembly has a primary member including a front portion, a central portion, a forward connecting member extending diagonally upwardly from a rear end of the front portion of the primary member to a forward end of the central portion of the primary member, a first aperture formed in the forward connecting member, a rear portion, a rear connecting member extending diagonally upwardly from a forward end of the rear portion of the primary member to a rear end of the central portion of the primary member, and a second aperture formed in rear connecting member. A secondary member includes a front portion, a central portion, a forward connecting member extending diagonally upwardly from a forward end of the central portion of the secondary member through the first aperture to a rear end of the front portion of the secondary member, a rear portion, a rear connecting member extending diagonally upwardly from a rear end of the central portion of the secondary member through the second aperture to a forward end of the rear portion of the secondary member, such that the front portion of the secondary member is positioned above and spaced from the front portion of the primary member, the central portion of the primary member is positioned above and spaced from the central portion of the secondary member, and the rear portion of the primary member is positioned above and spaced from the rear portion of the secondary member. An outsole is formed of a plurality of pieces, with one of the pieces being positioned beneath each of the front portion of the primary member, the central portion of the secondary member, and the rear portion of the primary member.

In accordance with a further aspect, an article of footwear includes an upper, a midsole positioned beneath the upper, and a support assembly positioned beneath the midsole. The support assembly has a primary member including a front portion having a upwardly curving front end, a central portion, a forward connecting member extending diagonally upwardly from a rear end of the front portion of the primary member to a forward end of the central portion of the primary member, a first aperture formed in the forward connecting member, a rear portion having an upwardly curving rear end, a rear connecting member extending diagonally upwardly from a forward end of the rear portion of the primary member to a rear end of the central portion of the primary member, and a second aperture formed in the rear connecting member. A secondary member includes a front portion having a downwardly curving forward end connected to the forward end of the front portion of the primary member, a central portion, a forward connecting member extending diagonally upwardly from a forward end of the central portion of the secondary member through the first aperture to a rear end of the front portion of the secondary member, a rear portion having a downwardly curving rear end connected to the rear end of the rear portion of the primary member, a rear connecting member extending diagonally upwardly from a rear end of the central portion of the secondary member through the second aperture to a forward end of the rear portion of the secondary member, such that the front portion of the secondary member is positioned above and spaced from the front portion of the primary member, the central portion of the primary member is positioned above and spaced from the central portion of the secondary member, and the rear portion of the primary member is positioned above and spaced from the rear portion of the secondary member. An outsole is formed of a plurality of pieces, with one of the pieces being positioned beneath each of the front portion of the primary member, the central portion of the secondary member, and the rear portion of the primary member.

In accordance with yet a further aspect, an article of footwear includes an upper and a midsole positioned beneath the upper. A support assembly positioned beneath the midsole includes a primary member having at least one aperture extending therethrough and at least one opening, each opening exposing a corresponding one of the apertures to an exterior of the primary member. A secondary member is engaged with the primary member such that a portion of the secondary member extends through each aperture and a portion of one of the primary member and the secondary member is positioned above the other of the primary member and the secondary member. An outsole is positioned beneath the support assembly.

By providing an article of footwear having a support assembly including a primary member and a secondary member according to certain embodiments, improved attenuation of impact forces can be achieved for the footwear. These and additional features and advantages disclosed here will be further understood from the following detailed disclosure of certain embodiments.

Figure 1:
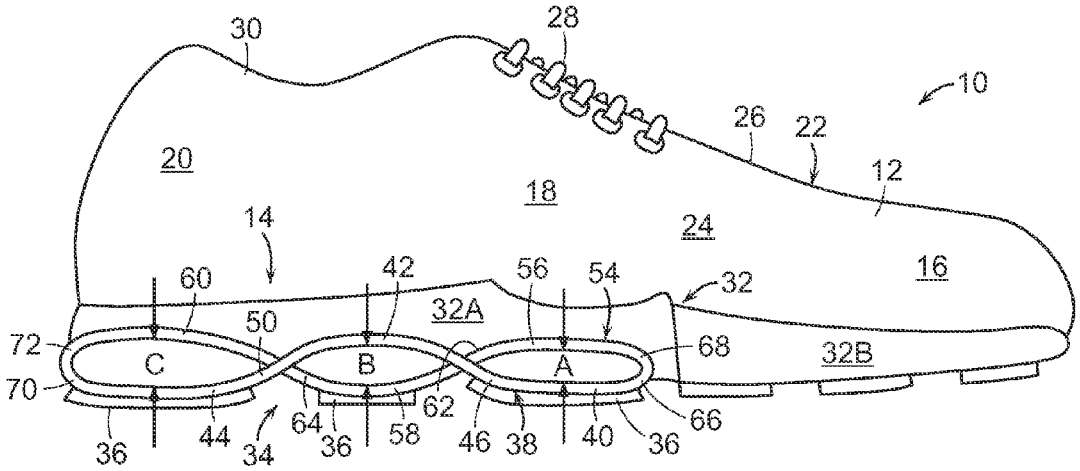
FIG. 1 is an elevation view of an article of footwear having a support assembly.
Figure 2:
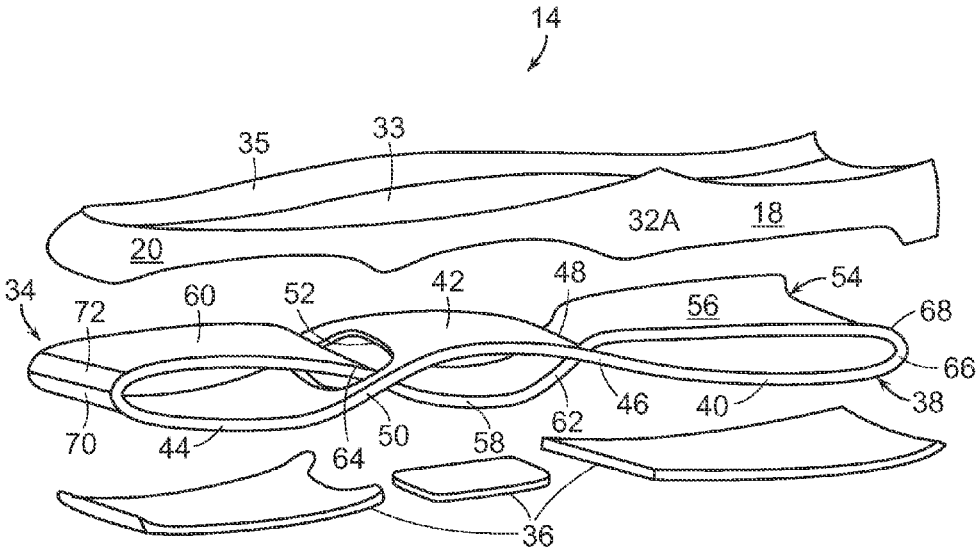
FIG. 2 is an exploded view of the support assembly of the footwear of FIG. 1.

The figures referred to above are not drawn necessarily to scale, should be understood to provide a representation of particular embodiments of the invention, and are merely conceptual in nature and illustrative of the principles involved. Some features of the footwear with a support assembly depicted in the drawings have been enlarged or distorted relative to others to facilitate explanation and understanding. The same reference numbers are used in the drawings for similar or identical components and features shown in various alternative embodiments. Footwear with a support assembly as disclosed herein would have configurations and components determined, in part, by the intended application and environment in which they are used.

DETAILED DESCRIPTION OF CERTAIN PREFERRED EMBODIMENTS

An article of footwear 10 is depicted in FIG. 1 as including an upper 12 and a sole assembly 14. For purposes of reference in the following description, footwear 10 may be divided into three general regions: a forefoot region 16, a midfoot region 18, and a heel region 20. Regions 16-20 are not intended to demarcate precise areas of footwear 10. Rather, regions 16-20 are intended to represent general areas of footwear 10 that provide a frame of reference during the following discussion. Although regions 16-20 apply generally to footwear 10, references to regions 16-20 also may apply specifically to upper 12, sole assembly 14, or individual components within either upper 12 or sole assembly 14.

Upper 12 defines a void or chamber for receiving a foot. For purposes of reference, upper 12 includes a lateral side 22, an opposite medial side 24, and a vamp or instep area 26. Lateral side 22 is positioned to extend along a lateral side of the foot (i.e., the outside) and generally passes through each of regions 16-20. Similarly, medial side 24 is positioned to extend along an opposite medial side of the foot (i.e., the inside) and generally passes through each of regions 16-20. Upper 12 may also include a closure mechanism, such as lace 28. Upper 12 also includes an ankle opening 30 that provides the foot with access to the void within upper 12.

Upper 12 may also include an insole (or sockliner, not shown), which is generally a thin, compressible member located within the void for receiving the foot and proximate to a lower surface of the foot. Typically, the insole, which is configured to enhance footwear comfort, may be formed of foam, and optionally a foam component covered by a moisture wicking fabric or textile material. Further, the insole or sockliner may be glued or otherwise attached to the other components of footwear 10, although it need not be attached, if desired.

Sole assembly 14 includes a midsole 32 positioned below upper 12. Midsole 32 may be formed of a resilient, polymer foam material, such as polyurethane or ethylvinylacetate ("EVA"). Other suitable materials for midsole 32 will become readily apparent to those skilled in the art, given the benefit of this disclosure. In certain embodiments, it is to be appreciated that midsole 32 may incorporate sealed chambers, fluid-filled bladders.

Midsole 32 may be directly secured to upper 12 with an adhesive, for example. Suitable adhesives are well known in the art and need not be discussed in greater detail here. Midsole 32 may be secured to upper 12 with any other suitable fastening means, and such other suitable means of midsole 32 to upper 12 will become readily apparent to those skilled in the art, given the benefit of this disclosure.

Midsole 32 may extend beneath the length and width of upper 12. In the illustrated embodiment, midsole 32 includes a first midsole portion 32A extending from heel portion 20 forwardly beneath midfoot portion 18, and a second midsole portion 32B extending beneath forefoot portion 16.

In certain embodiments, first midsole portion 32A includes a base portion 33 and a peripheral wall 35 extending upwardly from a periphery of base portion 33. In certain embodiments, an interior surface of the peripheral wall is concave in order to receive and mate with the exterior surface of upper 12, and an exterior surface of the peripheral wall is convex.

A support assembly 34 is positioned below midsole 32. Support assembly 34 serves to provide shock-attenuation and energy-absorption for footwear 10. In the embodiment illustrated here, support assembly 34 extends from heel portion 20 to midfoot portion 18, and is positioned beneath first midsole portion 32A. It is to be appreciated that support assembly 34 can extend beneath the entirety of midsole 32 and upper 12 or any portions thereof.

An outsole 36 is positioned below support assembly 34 as well as below midsole 32B in forefoot portion 16. Outsole 36 may be secured to support assembly 34 and midsole 32 with an adhesive, for example. Suitable adhesives are well known in the art and need not be discussed in greater detail here. Other suitable means of fastening outsole 36 to support assembly 34 and midsole 32 will become readily apparent to those skilled in the art, given the benefit of this disclosure.

Suitable materials for outsole 36 include any of the conventional rubber materials that are utilized in footwear outsoles, such as carbon black rubber compound. Other suitable materials for outsole 36 will become readily apparent to those skilled in the art, given the benefit of this disclosure.

In certain embodiments, outsole 36 may be formed of a layer of material secured to and extending over the bottom surface of each of support assembly 34 and midsole 32. In other embodiments, outsole 36 may be formed of a plurality of individual elements or pieces secured to the bottom surface of support assembly 34 and midsole 32.

As seen in FIGS. 2-6, support assembly 34 includes a primary member 38 including a front portion 40, a central portion 42, and a rear portion 44. Central portion 42 is raised with respect to both front portion 40 and rear portion 44. A forward connecting member 46 of primary member 38 extends diagonally upwardly from a rear end of front portion 40 to a forward end of central portion 42. A first aperture 48 extends though forward connecting member 46. A rear connecting member 50 of primary member 38 extends diagonally upwardly from a forward end of rear portion 44 to a rear end of central portion 42. A second aperture 52 extends through rear connecting member 50.

A secondary member 54 includes a front portion 56, a central portion 58, and a rear portion 60. Front portion 56 and rear portion 60 are raised with respect to central portion 58. A forward connecting member 62 of secondary member 54 extends diagonally upwardly from a forward end of central portion 58 to a rear end of front portion 56 and through first aperture 48 of primary member 38. A rear connecting member 64 of secondary member 54 extends diagonally upwardly from a rear end of central portion 58 to a forward end of rear portion 60 and through second aperture 52. It is to be appreciated that forward connecting member 62 and rear connecting member 64 have a width that is narrower than the remainder of support assembly 34 in order that they may fit through first aperture 48 and second aperture 52, respectively. It is also to be appreciated that central portion 58 of secondary member 54 may be narrower than the remainder of support assembly, and may have a width equivalent to a width of forward connecting member 62 and rear connecting member 64 of secondary member. Support assembly 34 is configured to extend beneath and across substantially the entire width of first midsole portion 32A.

A forward end 66 of front portion 40 of primary member 38 curves upwardly and connects with a downwardly curving forward end 68 of front portion 56 of secondary member 54. Similarly a rear end 70 of rear portion 44 of primary member 38 curves upwardly and connects with a downwardly curving rear end 72 of rear portion 60 of secondary member 54. In this illustrated embodiment, primary member 38 and secondary member 54 are thus connected to form a continuous ribbon defining support assembly 34. The ribbon of support assembly 34 forms a pair of FIG. 8 shapes overlapping one another.

It is to be appreciated that, in certain embodiments, support assembly 34 may not be formed of non-continuous members. That is, primary member 38 and secondary member 54 need not necessarily be non-continuous members. For example, a lateral heel portion of primary member 38 and/or secondary member 54 could be decoupled from the remainder of primary member 38 and/or secondary member 54, to create a crash pad. Further, in certain embodiments, different materials could be used to form different parts of primary member 38 and/or secondary member 54.

Different regions of support assembly 34 could be tuned or designed to have different performance characteristics. By varying the materials used to form different parts of support assembly 34, or decoupling one or more areas of support assembly 34 from other areas, the performance characteristics of support assembly 34 can be optimized. The performance characteristics of support assembly 34 and its component parts can also be tuned by varying other aspects of its geometry, such as the thickness or height of components of support assembly 34.

Primary member 38 and secondary member 54 are configured such that front portion 56 of secondary member 54 is positioned above and spaced from front portion 40 of primary member 38 by a gap A. In certain embodiments, gap A may have a height between approximately 1.0 mm and approximately 10.0 mm. In other embodiments, gap A may have height between approximately 1.0 mm and approximately 1.5 mm, while in other embodiments, gap A may have height between approximately 5.0 mm and approximately 10.0 mm.

Similarly, central portion 42 of primary member 38 is positioned above and spaced from central portion 58 of secondary member 54 by a gap B. In certain embodiments, gap B may have a height between approximately 1.0 mm and approximately 10.0 mm. In other embodiments, gap B may have height between approximately 1.0 mm and approximately 1.5 mm, while in other embodiments, gap B may have height between approximately 5.0 mm and approximately 10.0 mm.

Further, rear portion 60 of secondary member 54 is positioned above and spaced from rear portion 44 of primary member 38 by a gap C. In certain embodiments, gap C may have a height between approximately 1.0 mm and approximately 10.0 mm. In other embodiments, gap C may have height between approximately 1.0 mm and approximately 1.5 mm, while in other embodiments, gap C may have height between approximately 5.0 mm and approximately 10.0 mm.

It is to be appreciated that in certain embodiments, one or more of gaps A, B, and/or C, may be filled, or partially-filled, with material. For example, foam or other elastomer material, or a fluid-filled bladder, may be positioned within any of gaps A, B, and/or C. In certain embodiments, such materials may be positioned within only a bottom portion of any of gaps A, B, and/or C, to prevent support assembly 34 from bottoming out under compressive loading.

Figure 3:
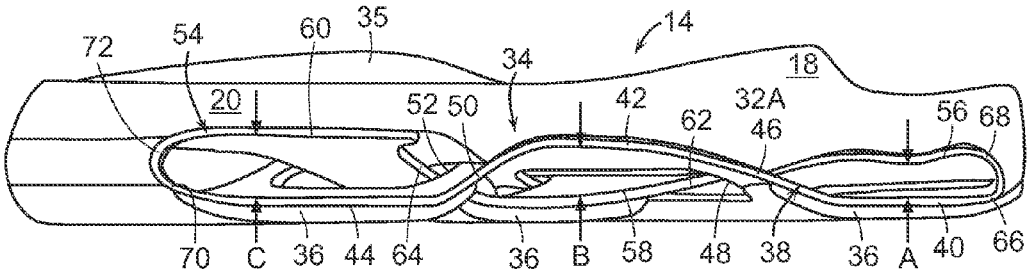
FIG. 3 is a perspective view of the support assembly of FIG. 1, shown in a static condition.
Figure 4:
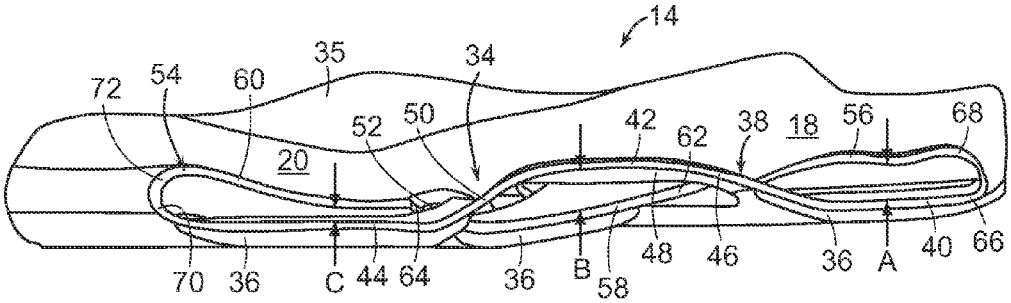
FIG. 4 is a perspective view of the support assembly of FIG. 1, shown in a partially compressed condition.
Figure 5:
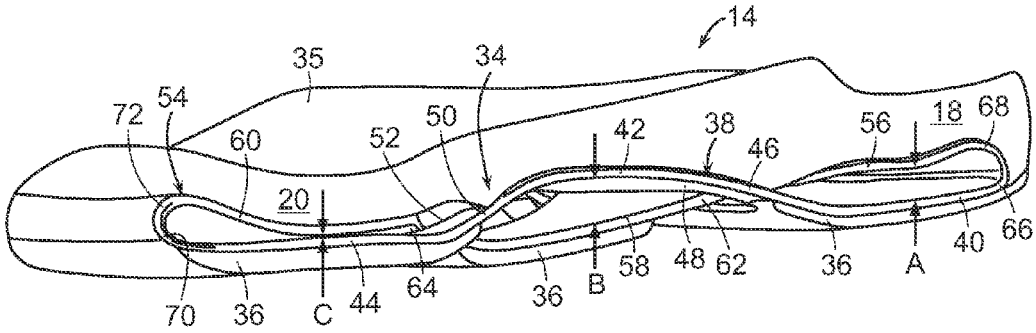
FIG. 5 is a perspective view of the support assembly of FIG. 1, shown with a heel portion of the support assembly completely compressed.

The configuration of support assembly 34 serves to allow it to act as a spring member, providing improved attenuation of impact forces for footwear 10. This is illustrated in FIGS. 3-7, with FIG. 3 showing support assembly 34 in a static unloaded condition. FIG. 4 shows support assembly 34 partially compressed under a compressive load in heel portion 20, illustrating the load encountered from a user's heel. FIG. 5 shows support assembly 34 with heel portion 20 completely compressed under a compressive load. In this condition, it can be seen that central portion 42 of primary member 38 is still spaced by gap B above central portion 58 of secondary member 54, and that forward portion 56 of secondary member 54 is still spaced by gap A above forward portion 40 of primary member 34, although gaps B and A may be smaller than they were in the static unloaded condition.

It is to be appreciated that as the compressive load from the user moves from heel portion 20 forward through midfoot portion 18 and then on to forefoot portion 16 as the user runs or walks, the high compressive load will also move forward. Thus, gap C will increase and gaps B and A will consequently successively decrease as the load moves forward.

Figure 6:
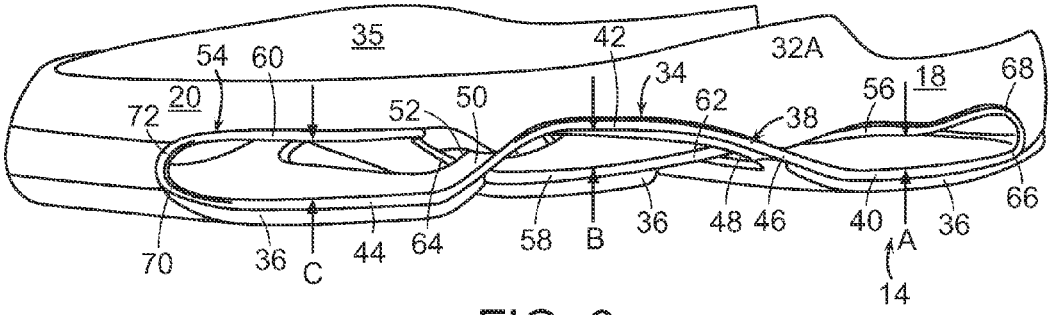
FIG. 6 is a perspective view of the support assembly of FIG. 1, shown in a static condition.
Figure 7:
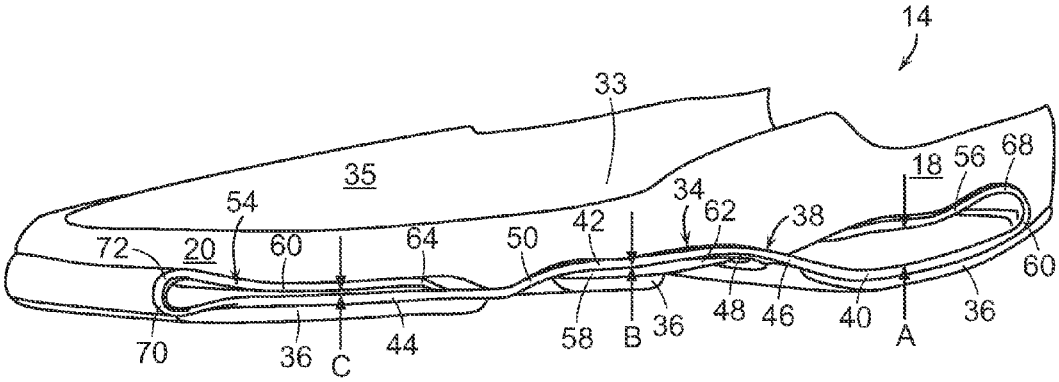
FIG. 7 is a perspective view of the support assembly of FIG. 1, shown under a shear load.

FIG. 6 shows support assembly 34 in a static unloaded condition, and FIG. 7 shows support assembly 34 compressed under a shear load in heel portion 20. In this condition, it can be seen that rear portion 60 of secondary member 54 and central portion 42 of primary member 38 have been compressed downwardly such that they contact rear portion 44 of primary member 38 and central portion 58 of secondary member 54, respectively.

In the illustrated embodiment, outsole 36 is formed of a plurality of pieces, with a piece of outsole 36 being positioned beneath and secured to a bottom surface of each of front portion 40 and rear portion 44 of primary member 38, and central portion 58 of secondary member 54.

In certain embodiments, support assembly 34 is formed of a polyether-block co-polyamide polymer, such as PEBAX®, available from Atofina Corporation of Puteaux, France. In other embodiments, support assembly 34 is formed of rubber. Other suitable materials for support assembly 34 will become readily apparent to those skilled in the art, given the benefit of this disclosure.

Figure 8:
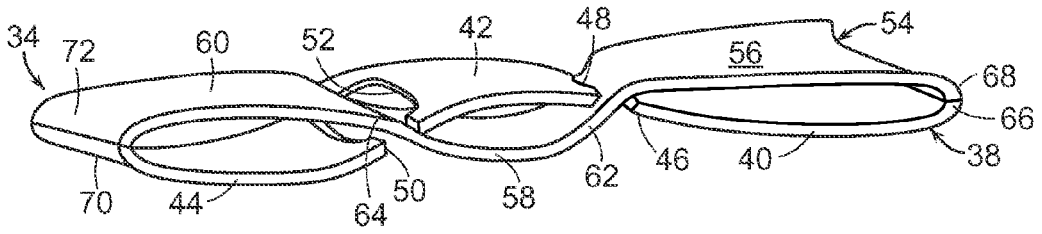
FIG. 8 is a perspective view of an alternative embodiment of the support assembly of FIG. 1.
Figure 9:
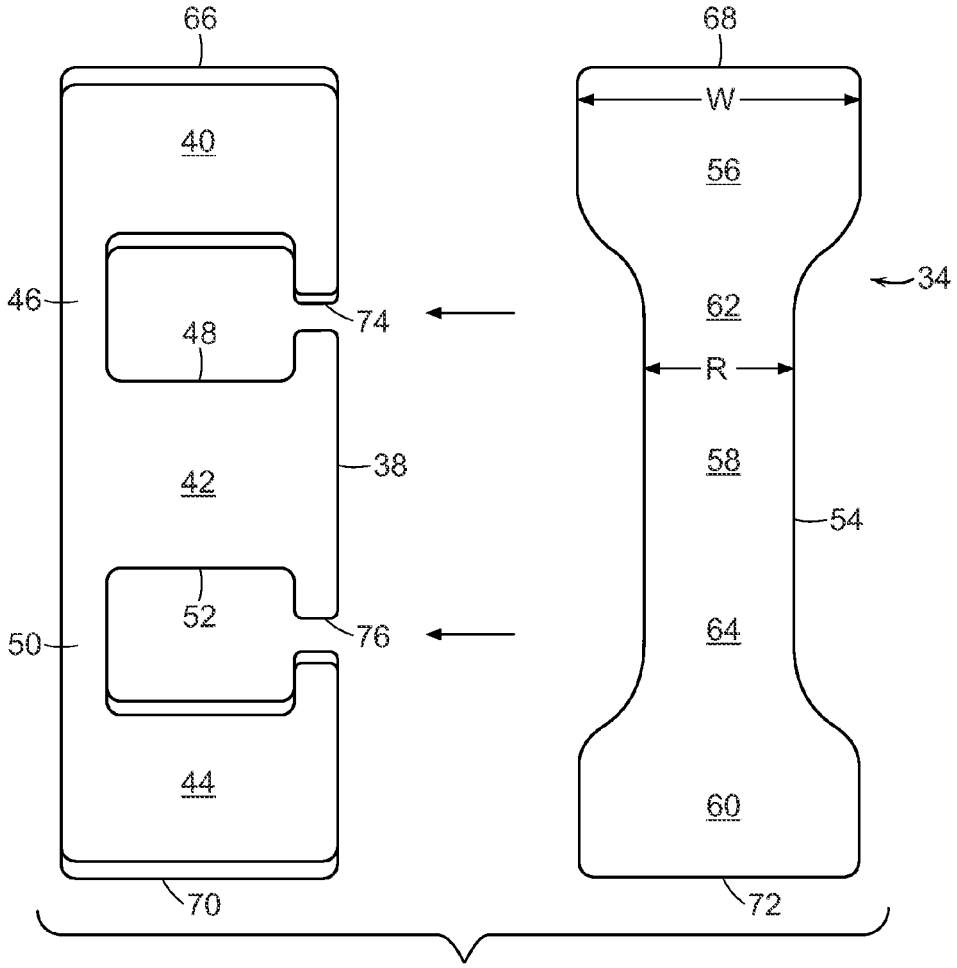
FIG. 9 is a plan view of the support assembly of FIG. 8, shown prior to assembly.

Another embodiment of support assembly 34 is seen in FIGS. 8 and 9. In this embodiment, primary member 38 and secondary member 54 are separate elements. Forward end 68 of secondary member 54 is seated on forward end 66 of primary member 38, and rear end 72 of secondary member 54 is seated on rear end 70 of primary member 38. It is to be appreciated that the forward and rear ends of primary member 38 and secondary member 54 may be secured to one another with any suitable fastening means, including adhesives, for example.

A first opening 74 is formed in a sidewall of primary member 38 and connects first aperture 48 with an exterior of primary member 38. In the illustrated embodiment, first opening 74 is formed in forward connecting member 46. Similarly, a second opening 76 is formed in a sidewall of primary member 38 and connects second aperture 52 with an exterior of primary member 38. In the illustrated embodiment, second opening 76 is formed in rear connecting member 50. As can be seen in FIG. 9, forward connecting member 62 and rear connecting member 64 of secondary member 54 can be slid through first and second openings 74, 76, respectively, until forward connecting member 62 and rear connecting member 64 are positioned within first aperture 48 and second aperture 52, respectively. Thus, first and second openings 74, 76 cause first aperture 48 and second aperture 52 to be slotted apertures, facilitating the assembly of secondary member 54 with primary member 38. That is, the apertures have slots providing access to the apertures from an exterior of primary member 38.

Figure 11:
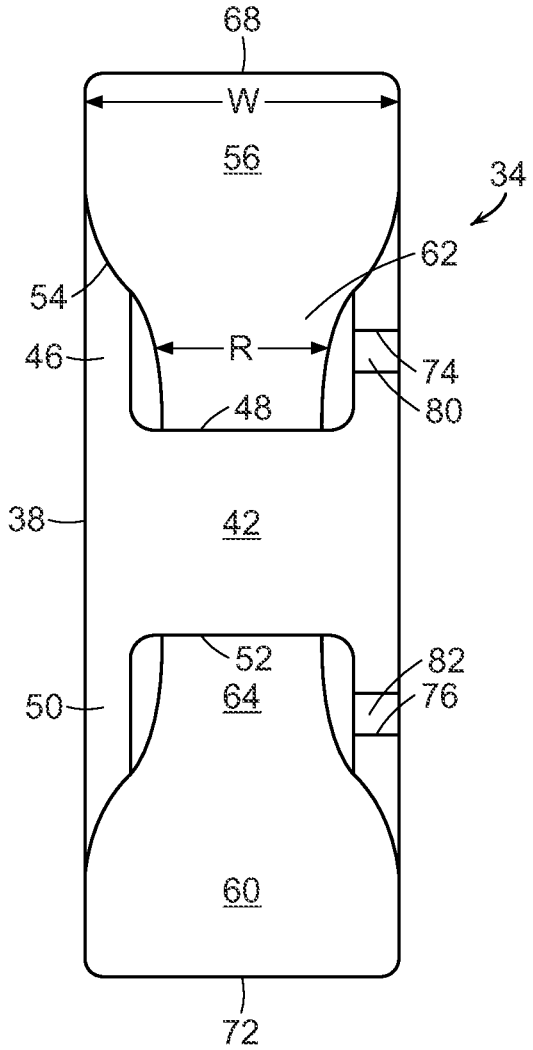
FIG. 11 is a plan view of the support assembly of FIG. 10, shown in an assembled condition.

When the secondary member is slid into engagement with the primary member, a portion of the secondary member is nested within each aperture of the primary member, as can be best seen in FIG. 11. It is to be appreciated that the primary member can have any number of slotted apertures, into each of which a portion of the secondary member can be nested.

As seen in FIGS. 9 and 11, a portion or portions of secondary member 54 has a first width W, while another portion or portions of secondary member 54 has a second width R that is less than width W. In the illustrated embodiment, front portion 56 and rear portion 60 of secondary member 54 have first width W while central portion 58 has second width R. The reduced width R helps in the engagement of secondary member 54 with primary member 38 such that portions of secondary member 54 can easily extend through the apertures of primary member 38.

In certain embodiments, after primary member 38 is slid into engagement with secondary member 54, a first insert 80 may be positioned within first aperture 74, and may be secured within first aperture with any suitable fastening means, such as an adhesive, for example. Similarly, after primary member 38 is slid into engagement with secondary member 54, a second insert 82 may be positioned within second aperture 76, and may be secured within first aperture with any suitable fastening means, such as an adhesive, for example.

It is also to be appreciated that in certain embodiments, a support assembly can include more than one primary member and more than one secondary member. Further, it is to be appreciated that any number of secondary members could be nested with a single primary member, or that a single secondary member could be nested with a plurality of primary members.

Figure 12:
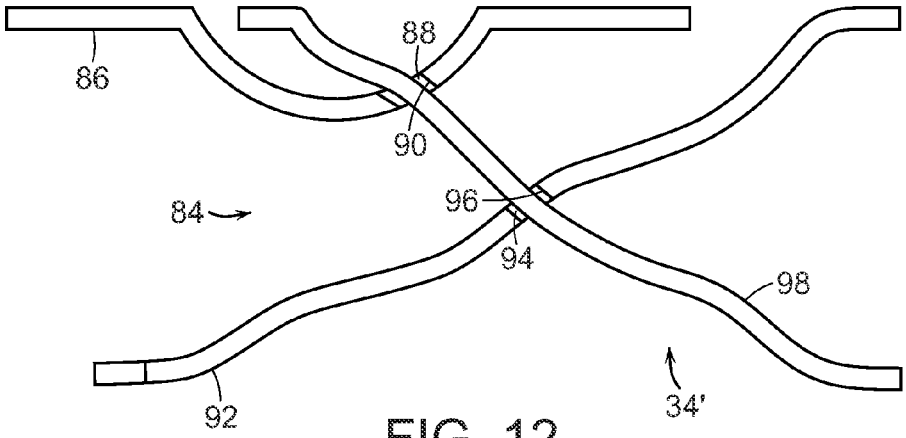
FIG. 12 is an elevation view of an alternative embodiment of the support assembly of FIG. 1.

For example, as shown in FIG. 12, a support assembly 84 includes a first primary member 86 having a first aperture 88 with a first opening 90 connecting first aperture 88 with an exterior of first primary member 86. A second primary member 92 includes a first aperture 94 with a first opening 96 connecting first aperture 94 with an exterior of second primary member 92. Portions of a secondary member 98 are received and nested within each of first aperture 88 of first primary member 86 and first aperture 94 of second primary member 92. To assemble support assembly 84, secondary member 98 is moved into engagement with primary members 86, 92 such that respective portions of secondary member 98 slide through first opening 90 of first primary member 86 and first opening 96 of second primary member 92 until those respective portions are positioned within and nested in first apertures 88, 94, respectively. It is to be appreciated that after engagement of secondary member 98 with primary members 86, 92, that inserts may be positioned and secured within first openings 90, 96.

Figure 13:
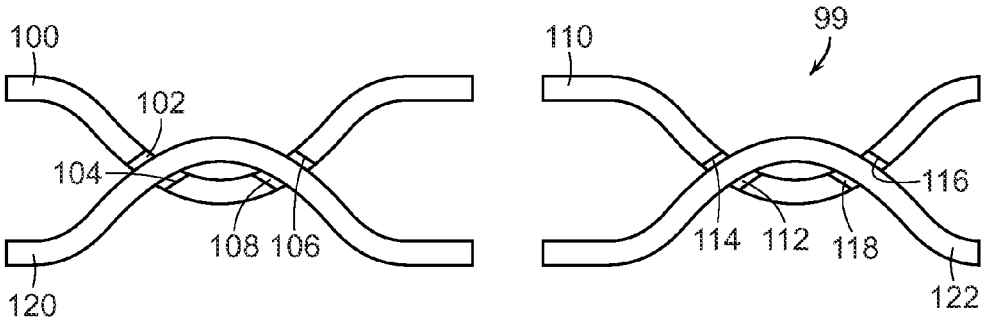
FIG. 13 is an elevation view of another alternative embodiment of the support assembly of FIG. 1.

Another example of a support assembly 99 is shown in FIG. 13, in which a first primary member 100 includes a first aperture 102 and a first opening 104 connecting first aperture 102 with an exterior of first primary member 100. A second opening 106 connects a second aperture 108 of first primary member 100 with an exterior of first primary member 100. A second primary member 110 includes a first aperture 112 and a first opening 114 connecting first aperture 112 with an exterior of second primary member 110. A second opening 116 connects a second aperture 118 of second primary member 110 with an exterior of second primary member 110.

Portions of a first secondary member 120 are received and nested within each of first aperture 102 and second aperture 108 of first primary member 100. Portions of a second secondary member 122 are received and nested within each of first aperture 112 and second aperture 118 of second primary member 110. To assemble support assembly 99, first secondary member 120 is moved into engagement with first primary member 100, such that respective portions of first secondary member 120 slide through first opening 104 and second opening 106 of first primary member 100 until those respective portions are positioned within and nested in first aperture 102 and second aperture 108, respectively. Similarly, second secondary member 122 is moved into engagement with second primary member 110, such that respective portions of secondary member 122 slide through first opening 114 and second opening 116 of second primary member 110 until those respective portions are positioned within and nested in first aperture 112 and second aperture 118, respectively. It is to be appreciated that after engagement of secondary members 120, 122 with primary members 100, 110, that inserts may be positioned and secured within first openings 104, 114 and second openings 106, 116.

Figure 14:
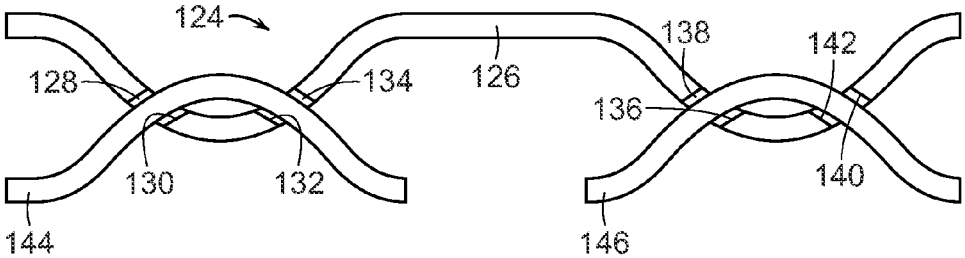
FIG. 14 is an elevation view of yet another alternative embodiment of the support assembly of FIG. 1.

A further embodiment of a support assembly 124 is shown in FIG. 14. In this embodiment, a primary member 126 includes a first aperture 128 and a first opening 130 connecting first aperture 128 with an exterior of primary member 126. A second opening 132 connects a second aperture 134 of primary member 126 with an exterior of primary member 126. A third opening 136 connects a third aperture 138 of primary member 126 with an exterior of primary member 126. A fourth opening 140 connects a fourth aperture 142 of primary member 126 with an exterior of primary member 126.

Portions of a first secondary member 144 are received and nested within each of first aperture 128 and second aperture 134 of primary member 126. Portions of a second secondary member 146 are received and nested within each of third aperture 138 and fourth aperture 142 of primary member 126. To assemble support assembly 124, first secondary member 144 is moved into engagement with primary member 126, such that respective portions of first secondary member 144 slide through first opening 130 and second opening 132 of primary member 126 until those respective portions are positioned within and nested in first aperture 128 and second aperture 134, respectively. Similarly, second secondary member 146 is moved into engagement with primary member 126, such that respective portions of second secondary member 146 slide through third opening 130 and fourth opening 140 of primary member 126 until those respective portions are positioned within and nested in third aperture 138 and fourth aperture 142, respectively. It is to be appreciated that after engagement of secondary members 144, 146 with primary member 126, that inserts may be positioned and secured within first opening 130, second opening 132, third opening 130, and fourth opening 140.

Figure 10:
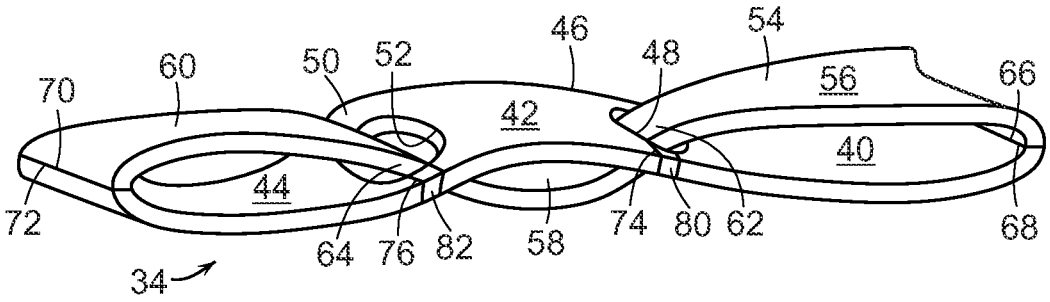
FIG. 10 is a perspective view of an alternative embodiment of the support assembly of FIG. 8.

It can be seen throughout FIGS. 8-14 that in certain embodiments, a portion of one of a primary member and a secondary member is positioned above the other of the primary member and the secondary member. Further, in certain embodiments, a portion of each of a primary member and a secondary member may be positioned above the other of the primary member and the secondary member. Additionally, multiple portions of a primary member or secondary member may be positioned above the other of the primary member and secondary member. For example, as seen in FIGS. 8 and 10, central portion 42 of primary member 38 is positioned above central portion 58 of secondary member 54, while front portion 56 of secondary member 54 is positioned above front portion 40 of primary member 38 and rear portion 60 of secondary member 54 is positioned above rear portion 44 of primary member 38.

It is to be appreciated that any number of portions of either a primary member or a secondary member can be positioned above a portion of the other of the primary member and the secondary member. Naturally, it is to be appreciated that portions of the primary and secondary members will be positioned below corresponding portions of the secondary and primary members, respectively.

Figure 15:
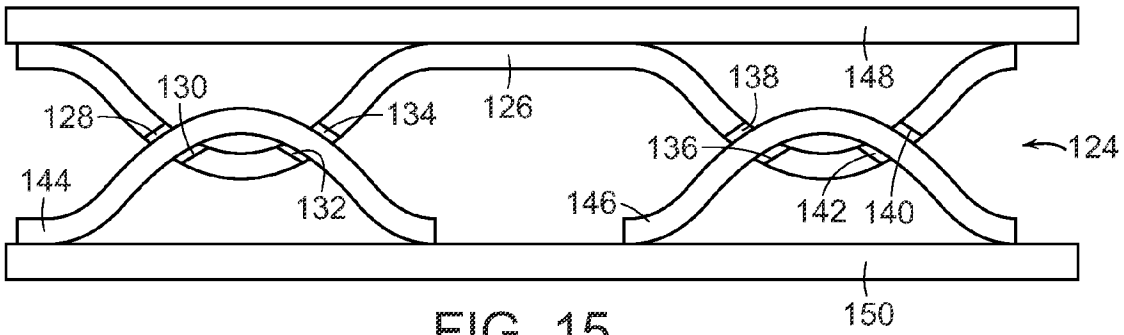
FIG. 15 is an elevation view of an alternative embodiment of the support assembly of FIG. 1, shown between and upper plate and a lower plate.

Another embodiment of support assembly 124 is seen in FIG. 15, in which support assembly 124 is positioned between a top or upper plate 148 and a bottom or lower plate 150. Support assembly 124 may be secured to upper plate 148 and lower plate 150 with an adhesive, for example. Suitable adhesives are well known in the art and need not be discussed in greater detail here. Upper plate 148 and lower plate 150 may be formed of the same material as that of support assembly 124. In other embodiments, upper plate 148 and lower plate 150 may be formed of a different material than that of support assembly 124. It is further to be appreciated that upper plate 148 and lower plate 150 need not be formed of the same material as one another.

Figure 16:
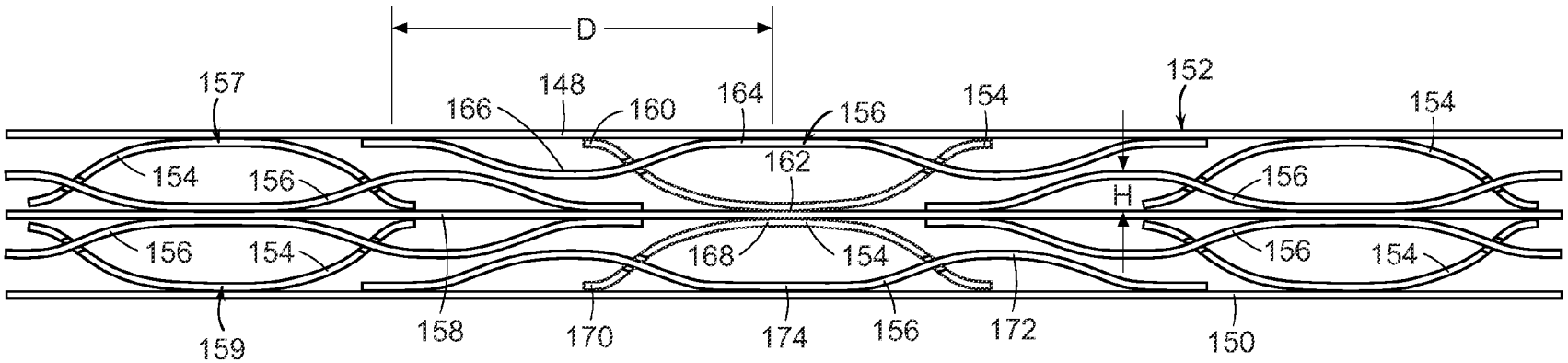
FIG. 16 is an elevation view of an alternative embodiment of the support assembly of FIG. 15.

Another embodiment of a support assembly 152 is seen in FIG. 16. In this embodiment, support assembly 152 includes a plurality of primary members 154 and corresponding secondary members 156 that are inserted through corresponding openings in primary members 154 and are nested within corresponding apertures within primary members 154. It is to be appreciated that support assembly 152 can include any number of primary members 154 and secondary members 156.

In the embodiment illustrated here, a central plate 158 is positioned between upper plate 148 and lower plate 150, and primary members 154 and secondary members 156 are positioned both between central plate 158 and upper plate 148 and between central plate 158 and lower plate 150. In the illustrated embodiment, a first set 157 of primary members 154 and secondary members 156 are positioned between upper plate 148 and central plate 158, and a second set 159 of primary members 154 and secondary members 156 are positioned between lower plate 150 and central plate 158. In the embodiment illustrated here, first set 157 of primary members 154 and secondary members 156 above central plate 158 is a mirror image of second set 159 positioned below central plate 158. It is to be appreciated that the primary members and secondary members of both sets can have any desired configuration.

In the illustrated embodiment, primary members 154 and secondary members 156 have wave-like profiles. Thus, for example, the primary members 154 above central plate 158 include crests 160 and troughs 162. The secondary members 156 above central plate 158 also have crests 164 and troughs 166. Similarly, the primary members 154 below central plate 158 include crests 168 and troughs 170. The secondary members 156 below central plate 158 also have crests 172 and troughs 174.

It is to be appreciated that the frequency of the wave-like profiles of the primary and secondary members 154, 156, that is, the distance D between crests and between troughs, can be varied throughout support assembly 152. Similarly, the amplitude of the wave-like profiles of the primary and secondary members 154, 156, that is, the height H of the crests and depth of the troughs, can be varied throughout support assembly 152. Further, the frequency and amplitude of any primary member 154 need not be the same as any other primary member 154. One or more primary members 154 may have the same configuration as any other single primary member 154 or any plurality of primary members 154.

Similarly, the frequency and amplitude of any secondary member 156 need not be the same as any other secondary member 156. One or more secondary members 156 may have the same configuration as any other single secondary member 156 or any plurality of secondary members 156. As illustrated here, the primary members 154 and secondary members 156 are symmetrical, but it is to be appreciated that one or more primary members 154 and secondary members 156 of support assembly 152 can be asymmetrical.

Further, it is to be appreciated that the asymmetry of the components of support assembly 152 can be brought about by varying any number of characteristics of primary members 154 and secondary members 156. For example, any one or more of the frequency and amplitude of the wave-like profiles of primary members 154 and secondary members 156, as well as any one or more of the width and thickness of the individual primary members 154 and secondary members 156 can be varied. Further, the thickness of primary members 154 and secondary members 156 can be varied from lateral side 22 to medial side 24. It is to be appreciated that any characteristic of primary members 154 and secondary members 156 can be varied to provide the asymmetry of support assembly 152.

Further, any one, or more than one, of the openings of the primary members 156 may be filled with an insert after the secondary members 156 are nested within the primary members 156 in the manner described above. Thus, it is to be appreciated that the primary and secondary members of a support assembly and take many different configurations.

Thus, while there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. An article of footwear comprising:

an upper;

a midsole positioned beneath the upper;

a support assembly positioned beneath the midsole and comprising:

a primary member including a front portion, a central portion, a rear portion, a first aperture formed in the primary member between the front and central portions, and a second aperture formed in the primary member between the central and rear portions; and a secondary member including a front portion, a central portion, and a rear portion, the secondary member extending through the first aperture and the second aperture such that the front portion of the secondary member is positioned directly above the front portion of the primary member, the central portion of the primary member is positioned directly above the central portion of the secondary member, and the rear portion of the secondary member is positioned directly above the rear portion of the primary member; and an outsole positioned beneath the support assembly.

2. The article of footwear of claim 1, wherein the outsole is formed of a plurality of pieces, a piece being positioned beneath each of the front portion of the primary member, the rear portion of the primary member, and the central portion of the secondary member.

3. The article of footwear of claim 1, wherein the support assembly is positioned beneath a heel portion of the upper.

4. The article of footwear of claim 1, wherein the support assembly is formed of a polyether-block co-polyamide polymer.

5. The article of footwear of claim 1, wherein the support assembly is formed of rubber.

6. The article of footwear of claim 1, wherein the midsole includes a base portion and a peripheral wall extending upwardly from a periphery of the base portion.

7. The article of footwear of claim 6, wherein an interior surface of the peripheral wall is concave and an exterior surface of the peripheral wall is convex.

8. The article of footwear of claim 1, wherein a forward end of the front portion of the primary member is connected to a forward end of the front portion of the secondary member.

9. The article of footwear of claim 1, wherein a rear end of the rear portion of the primary member is connected to a rear end of the rear portion of the secondary member.

10. The article of footwear of claim 1, wherein a forward end of the primary member is connected to a forward end of the secondary member and a rear end of the primary member is connected to a rear end of the secondary member.

11. The article of footwear of claim 1, wherein the primary member and the secondary member combine to form a continuous ribbon forming the support assembly.

12. The article of footwear of claim 1, further comprising:

a forward connecting member of the primary member extending diagonally upwardly from a rear end of the front portion of the primary member to a forward end of the central portion of the primary member;

a rear connecting member of the primary member extending diagonally upwardly from a forward end of the rear portion of the primary member to a rear end of the central portion of the primary member;

a forward connecting member of the secondary member extending diagonally upwardly from a forward end of the central portion of the secondary member to a rear end of the front portion of the secondary member; and a rear connecting member of the secondary member extending diagonally upwardly from a rear end of the central portion of the secondary member to a forward end of the rear portion of the secondary member.

13. The article of footwear of claim 12, wherein the forward connecting member of the secondary member extends through the first aperture of the primary member, and the rear connecting member of the secondary member extends through the second aperture of the primary member.

14. The article of footwear of claim 1, wherein:

a forward end of the front portion of the primary member curves upwardly;

a forward end of the front portion of the secondary member curves downwardly and connects with the forward end of the front portion of the primary member;

a rear end of the rear portion of the primary member curves upwardly; and a rear end of the rear portion of the secondary member curves downwardly and connects with the rear end of the rear portion of the primary member.

15. The article of footwear of claim 1, wherein the front portion of the secondary member is spaced from the front portion of the primary member, the central portion of the primary member is spaced from the central portion of the secondary member, and the rear portion of the primary member is spaced from the rear portion of the secondary member.

16. The article of footwear of claim 1, wherein the midsole includes a first midsole portion extending from a heel portion of the upper forwardly to a midfoot portion of the upper, and a second midsole portion extending beneath a forefoot portion of the upper.

17. An article of footwear comprising:

an upper;

a midsole positioned beneath the upper;

a support assembly positioned beneath the midsole and comprising:

a primary member including a front portion, a central portion, a forward connecting member extending diagonally upwardly from a rear end of the front portion of the primary member to a forward end of the central portion of the primary member, a first aperture formed in the forward connecting member, a rear portion, a rear connecting member extending diagonally upwardly from a forward end of the rear portion of the primary member to a rear end of the central portion of the primary member, and a second aperture formed in the rear connecting member; and a secondary member including a front portion, a central portion, a forward connecting member extending diagonally upwardly from a forward end of the central portion of the secondary member through the first aperture to a rear end of the front portion of the secondary member, a rear portion, a rear connecting member extending diagonally upwardly from a rear end of the central portion of the secondary member through the second aperture to a forward end of the rear portion of the secondary member, such that the front portion of the secondary member is positioned directly above and spaced from the front portion of the primary member, the central portion of the primary member is positioned directly above and spaced from the central portion of the secondary member, and the rear portion of the secondary member is positioned directly above and spaced from the rear portion of the primary member; and an outsole formed of a plurality of pieces, one of the pieces being positioned beneath each of the front portion of the primary member, the central portion of the secondary member, and the rear portion of the primary member.

18. The article of footwear of claim 17, wherein a forward end of the primary member is connected to a forward end of the secondary member and a rear end of the primary member is connected to a rear end of the secondary member.

19. The article of footwear of claim 17, wherein:

a forward end of the front portion of the primary member curves upwardly;

a forward end of the front portion of the secondary member curves downwardly and connects with the forward end of the front portion of the primary member;

a rear end of the rear portion of the primary member curves upwardly; and a rear end of the rear portion of the secondary member curves downwardly and connects with the rear end of the rear portion of the primary member.

20. An article of footwear comprising:

an upper;

a midsole positioned beneath the upper;

a support assembly positioned beneath the midsole and comprising:

a primary member including a front portion having an upwardly curving front end, a central portion, a forward connecting member extending diagonally upwardly from a rear end of the front portion of the primary member to a forward end of the central portion of the primary member, a first aperture formed in the forward connecting member, a rear portion having an upwardly curving rear end, a rear connecting member extending diagonally upwardly from a forward end of the rear portion of the primary member to a rear end of the central portion of the primary member, and a second aperture formed in the rear connecting member; and a secondary member including a front portion having a downwardly curving forward end connected to the forward end of the front portion of the primary member, a central portion, a forward connecting member extending diagonally upwardly from a forward end of the central portion of the secondary member through the first aperture to a rear end of the front portion of the secondary member, a rear portion having a downwardly curving rear end connected to the rear end of the rear portion of the primary member, a rear connecting member extending diagonally upwardly from a rear end of the central portion of the secondary member through the second aperture to a forward end of the rear portion of the secondary member, such that the front portion of the secondary member is positioned directly above and spaced from the front portion of the primary member, the central portion of the primary member is positioned directly above and spaced from the central portion of the secondary member, and the rear portion of the secondary member is positioned directly above and spaced from the rear portion of the primary member; and an outsole formed of a plurality of pieces, one of the pieces being positioned beneath each of the front portion of the primary member, the central portion of the secondary member, and the rear portion of the primary member.

21. An article of footwear comprising:

an upper;

a midsole positioned beneath the upper;

a support assembly positioned beneath the midsole and comprising:

a primary member having at least one aperture and at least one opening extending therethrough, each opening extending from a corresponding one of the at least one apertures to an exterior of the primary member on one of a lateral and a medial side of the primary member so as to define a gap in the primary member; and a secondary member engaged with the primary member such that a portion of the secondary member extends through each aperture and a portion of one of the primary member and the secondary member is positioned above the other of the primary member and the secondary member; and an outsole positioned beneath the support assembly.

22. The article of footwear of claim 21, further comprising an insert positioned within each opening.

23. The article of footwear of claim 21, wherein each opening is formed in a sidewall of a corresponding primary member.

24. The article of footwear of claim 21, wherein a first portion of the secondary member has a first width, and each portion of the secondary member that extends through an aperture has a second width that is less than the first width.

25. The article of footwear of claim 21, wherein the support assembly includes an additional primary member having at least one aperture extending therethrough and at least one opening, each opening exposing a corresponding one of the apertures to an exterior of the primary member; and the secondary member is engaged with the additional primary member such that a portion of the secondary member extends through each aperture of the additional primary member.

26. The article of footwear of claim 21, wherein the primary member includes at least two apertures and at least two corresponding openings; and the support assembly includes an additional secondary member engaged with the primary member such that a portion of the additional secondary member extends through one of the apertures of the primary member.

27. The article of footwear of claim 21, wherein the support assembly includes:

a plurality of additional primary members, each additional primary member having at least one aperture extending therethrough and at least one opening, each opening exposing a corresponding one of the apertures to an exterior of the additional primary member; and a plurality of additional secondary members, each additional secondary member engaged with at least one of the primary members such that a portion of each additional secondary member extends through an aperture of one of the primary members.

28. The article of footwear of claim 21, wherein the support assembly includes an additional secondary member engaged with the primary member such that a portion of the additional secondary member extends through an aperture of the primary member.

29. The article of footwear of claim 21, wherein the primary member is secured to the secondary member.

30. The article of footwear of claim 21, wherein the support assembly includes an upper plate and a lower plate, each primary member and each secondary member being positioned between the upper plate and the lower plate.

31. The article of footwear of claim 30, wherein the support assembly includes:

a plurality of additional primary members, each additional primary member having at least one aperture extending therethrough and at least one opening, each opening exposing a corresponding one of the apertures to an exterior of the additional primary member; and a plurality of additional secondary members, each additional secondary member engaged with at least one of the primary members such that a portion of each additional secondary member extends through an aperture of one of the primary members;

each primary member has a wave-like profile including at least one crest and at least one trough; and each secondary member has a wave-like profile including at least one crest and at least one trough.

32. The article of footwear of claim 21, wherein the support assembly further comprises:

an upper plate;

a lower plate spaced from the upper plate;

a central plate positioned between the upper plate and the lower plate;

a plurality of additional primary members, each additional primary member having at least one aperture extending therethrough and at least one opening, each opening exposing a corresponding one of the apertures to an exterior of the additional primary member; and a plurality of additional secondary members, each additional secondary member engaged with at least one of the primary members such that a portion of each additional secondary member extends through an aperture of one of the primary members;

wherein a first set of primary members and corresponding secondary members is positioned between the upper plate and the central plate; and a second set of primary members and corresponding secondary members is positioned between the upper plate and the central plate.

33. The article of footwear of claim 32, wherein each primary member has a wave-like profile including at least one crest and at least one trough.

34. The article of footwear of claim 32, wherein each secondary member has a wave-like profile including at least one crest and at least one trough.

* * * * *